US008948419B2

(12) United States Patent
Zhang

(10) Patent No.: US 8,948,419 B2
(45) Date of Patent: Feb. 3, 2015

(54) MICROPHONE WITH BACKPLATE HAVING SPECIALLY SHAPED THROUGH-HOLES

(75) Inventor: Xin Zhang, Acton, MA (US)

(73) Assignee: Invensense, Inc., San Jose, CA (US)

( * ) Notice: Subject to any disclaimer, the term of this patent is extended or adjusted under 35 U.S.C. 154(b) by 141 days.

(21) Appl. No.: 12/939,504

(22) Filed: Nov. 4, 2010

(65) Prior Publication Data

US 2011/0075866 A1 Mar. 31, 2011

Related U.S. Application Data

(63) Continuation-in-part of application No. 12/133,599, filed on Jun. 5, 2008.

(60) Provisional application No. 61/261,442, filed on Nov. 16, 2009.

(51) Int. Cl.

| | |
|---|---|
| ***H04R 25/00*** | (2006.01) |
| ***H04R 19/04*** | (2006.01) |
| ***H04R 1/22*** | (2006.01) |
| ***H04R 7/20*** | (2006.01) |
| ***H04R 31/00*** | (2006.01) |
| *H04R 19/00* | (2006.01) |

(52) U.S. Cl.

CPC ..... *H04R 19/04* (2013.01); *H04R 1/222* (2013.01); *H04R 7/20* (2013.01); *H04R 31/00* (2013.01); *H04R 19/005* (2013.01); *H04R 2201/34* (2013.01); *H04R 2400/11* (2013.01); *H04R 2499/11* (2013.01)

USPC ..... 381/174; 381/175

(58) Field of Classification Search

None

See application file for complete search history.

(56) References Cited

U.S. PATENT DOCUMENTS

| | | | | |
|---|---|---|---|---|
| 4,776,019 | A * | 10/1988 | Miyatake | 381/174 |
| 5,684,324 | A * | 11/1997 | Bernstein | 257/415 |
| 5,870,482 | A | 2/1999 | Loeppert et al. | 381/174 |
| 7,190,038 | B2 * | 3/2007 | Dehe et al. | 257/415 |
| 7,329,933 | B2 | 2/2008 | Zhe et al. | 257/419 |
| 7,804,969 | B2 | 9/2010 | Wang et al. | 381/174 |
| 2007/0195976 | A1 | 8/2007 | Sekino et al. | 381/191 |
| 2008/0304681 | A1 | 12/2008 | Langlois et al. | 381/174 |
| 2009/0208037 | A1 | 8/2009 | Zhe | 381/174 |

FOREIGN PATENT DOCUMENTS

| | | | |
|---|---|---|---|
| WO | WO 01/67810 | 9/2011 | H04R 19/00 |

OTHER PUBLICATIONS

International Searching Authority, International Search Report—International Application No. PCT/US2010/055404, dated Feb. 16, 2011, together with the Written Opinion of the International Searching Authority, 9 pages.

* cited by examiner

*Primary Examiner* — Duc Nguyen
*Assistant Examiner* — Taunya McCarty
(74) *Attorney, Agent, or Firm* — Maryam Imam; IPxLaw Group LLP

(57) ABSTRACT

A MEMS microphone has 1) a backplate with a backplate interior surface and a plurality of through-holes, and 2) a diaphragm spaced from the backplate. The diaphragm is movably coupled with the backplate to form a variable capacitor. At least two of the through-holes have an inner dimensional shape (on the backplate interior surface) with a plurality of convex portions and a plurality of concave portions.

4 Claims, 15 Drawing Sheets

MICROPHONE WITH BACKPLATE HAVING SPECIALLY SHAPED THROUGH-HOLES

PRIORITY

This patent application claims priority from provisional U.S. patent application No. 61/261,442, filed Nov. 16, 2009, entitled, "MICROPHONE WITH BACKPLATE HAVING NON-CIRCULAR THROUGH-HOLES,", and naming Xin Zhang as inventor, the disclosure of which is incorporated herein, in its entirety, by reference.

This patent application also is a continuation-in-part of U.S. patent application Ser. No. 12/133,599, filed Jun. 5, 2008, entitled, "MICROPHONE WITH ALIGNED APERTURES," and naming Eric Langlois, Thomas Chen, Xin Zhang, and Kieran P. Harney as inventors, the disclosure of which is incorporated herein, in its entirety, by reference.

TECHNICAL FIELD

The invention generally relates to MEMS microphones and, more particularly, the invention relates to improving the signal-to-noise ratio of MEMS microphones.

BACKGROUND ART

To detect audio signals, MEMS microphones typically have a static backplate that supports and forms a capacitor with a flexible diaphragm. Audio signals cause the diaphragm to vibrate, thus producing a changing capacitance. Circuitry receives and converts this changing capacitance into electrical signals that can be further processed.

To sense an incoming audio signal, the diaphragm should be able to vibrate in a substantially unimpeded manner. If the backplate were solid, then air between it and the diaphragm would significantly resist that vibration. Accordingly, MEMS microphones typically have a plurality of generally round holes extending through the backplate. Air in the space between the diaphragm and backplate therefore can escape through these through-holes, thus providing reasonable sensitivity to incoming audio signals.

Round through-holes typically provide excellent air resistance properties—compared to other shapes with the same area, they often create the lowest air resistance. Their geometry, however, undesirably limits their total number through the backplate.

SUMMARY OF THE INVENTION

In accordance with one embodiment of the invention, a MEMS microphone has 1) a backplate with a backplate interior surface and a plurality of through-holes, and 2) a diaphragm spaced from the backplate. The diaphragm is movably coupled with the backplate to form a variable capacitor. At least two of the through-holes have an inner dimensional shape (on the backplate interior surface) with a plurality of convex portions and a plurality of concave portions.

The inner dimensional shape can take on a number of different configurations. For example, it may be generally cross-shaped and/or have a hub and a plurality of lobes extending from the hub. At least one of the lobes may have a generally straight portion. The inner dimensional shape is generally symmetrical or generally asymmetrical.

In addition to the noted through-holes, the plurality of through-holes can include a generally circular through-hole.

The backplate may have an outer perimeter defining a backplate area. Thus, in some embodiments, at least two through-holes have a combined area that is greater than or equal to about 60 percent of the backplate area.

In accordance with another embodiment of the invention, a MEMS microphone has 1) a backplate with a backplate interior surface and a plurality of through-holes, and 2) a diaphragm, spaced from the backplate, and movably coupled with the backplate to form a variable capacitor. At least two of the through-holes have an inner dimensional shape on the backplate interior surface. This inner dimensional shape has a hub and a plurality of lobes extending from the hub.

In accordance with other embodiments of the invention, a MEMS microphone has a backplate with a backplate interior surface and a plurality of through-holes, a diaphragm spaced from the backplate and movably coupled with the backplate to form a variable capacitor, and a support portion between the backplate and the diaphragm. The microphone also has a spring securing the diaphragm to the support portion. The spring forms a spring opening, between the diaphragm and the support portion, having a spring opening shape. At least one of the through-holes has an inner dimensional shape that is substantially the same as the spring opening shape.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a MEMS microphone has an improved signal-to-noise ratio despite the fact that its variable capacitor backplate has less area. To that end, the microphone has a backplate with a plurality of specially shaped through-holes. The shape of the through-holes permits more hole area to be distributed across the backplate, reducing air flow resistance. The unusual shape, however, does not significantly sacrifice the output signal of the variable capacitor. Consequently, the microphone should be less susceptible to noise while maintaining a sufficient signal level and thus, have a relatively high signal-to-noise ratio. Details of illustrative embodiments are discussed below.

Figure 1:
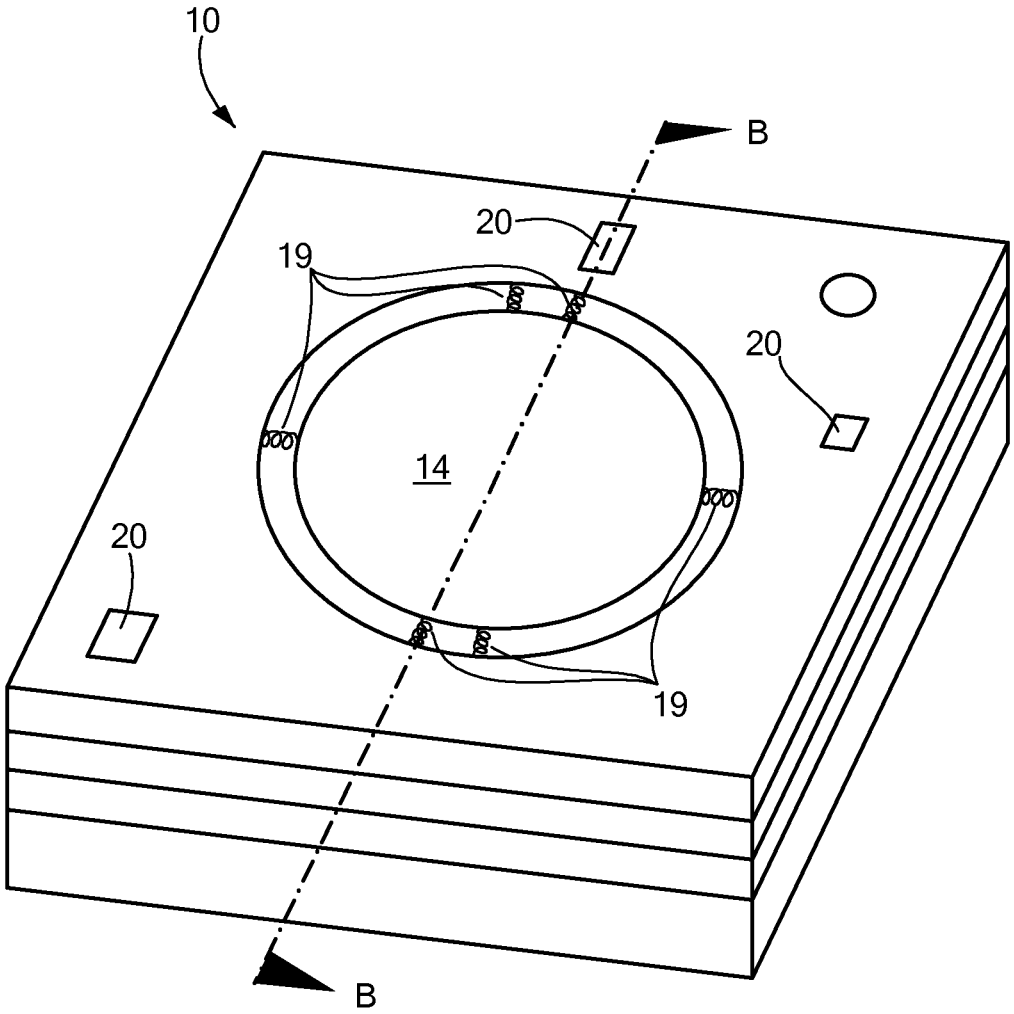
FIG. 1 schematically shows a perspective view of a MEMS device that may be configured in accordance with illustrative embodiments of the invention.
Figure 2:
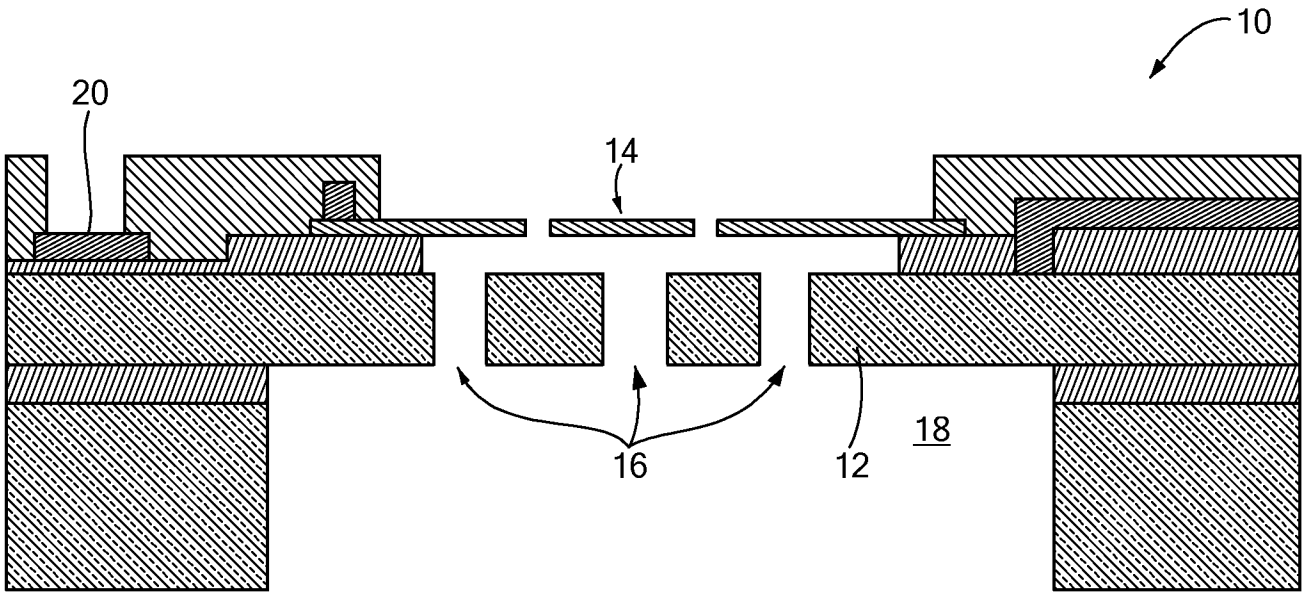
FIG. 2 schematically shows a cross-sectional view across line B-B of the MEMS device shown in FIG. 1 in accordance with one embodiment of the invention.

FIG. 1 schematically shows a MEMS microphone (also referred to as a "microphone chip 10") that may be configured in accordance illustrative embodiments of the invention. FIG. 2 schematically shows a cross-section of the same microphone 10 across line B-B of FIG. 1 in accordance with a first embodiment of the invention.

Among other things, the microphone 10 includes a static backplate 12 that supports and forms a variable capacitor (noted above) with a flexible diaphragm 14. In illustrative embodiments, the backplate 12 is formed at least in part from single crystal silicon (e.g., the top layer of a silicon-on-insulator wafer), while the diaphragm 14 is formed at least in part from deposited polysilicon. Other embodiments, however, use other types of materials to form the backplate 12 and the diaphragm 14. For example, a single crystal silicon bulk wafer, or some deposited material may at least in part form the backplate 12. In a similar manner, a single crystal silicon bulk wafer, part of a silicon-on-insulator wafer, or some other deposited material may form at least part of the diaphragm 14. To facilitate operation, the backplate 12 has a plurality of specially configured through-holes 16 that lead to a backside cavity 18. As noted above and discussed in greater detail below, these specially configured through-holes 16 improve the signal-to-noise ratio.

Springs 19 movably connect the diaphragm 14 to the static portion (i.e., a support portion) of the microphone 10, which includes a substrate that in part forms the backplate 12. Audio/acoustic signals cause the diaphragm 14 to vibrate, thus producing a changing capacitance. On-chip or off-chip circuitry (not shown) receives (via contacts 20) and converts this changing capacitance into electrical signals that can be further processed. It should be noted that discussion of the specific microphone 10 shown in FIGS. 1 and 2 is for illustrative purposes only. Various embodiments thus may use other microphone configurations.

To his surprise, the inventor discovered that he could reduce the total surface area of the backplate 12 facing the diaphragm 14 and, at the same time, increase the signal-to-noise ratio. More specifically, against the conventional wisdom known to him, the inventor increased the total number of through-holes 16 through the backplate 12 to reduce air flow resistance. Such a backplate 12 thus should have a lower noise component due to air flow resistance. Undesirably, however, this configuration reduces the total backplate area. In particular, since capacitance is a function of area, reducing this surface area and using circular through-holes is expected to reduce the signal produced by the variable capacitor formed by the diaphragm 14 and backplate 12.

To increase the signal, however, the inventor discovered that an increase in the fringe capacitance produced by long, meandering perimeters of the through-holes 16 can significantly mitigate the impact of lost capacitance due to reduced area. To meet this requirement, the through-holes 16 should have a specially configured shape—one that preferably maximizes or enhances fringe capacitance.

Figure 3:
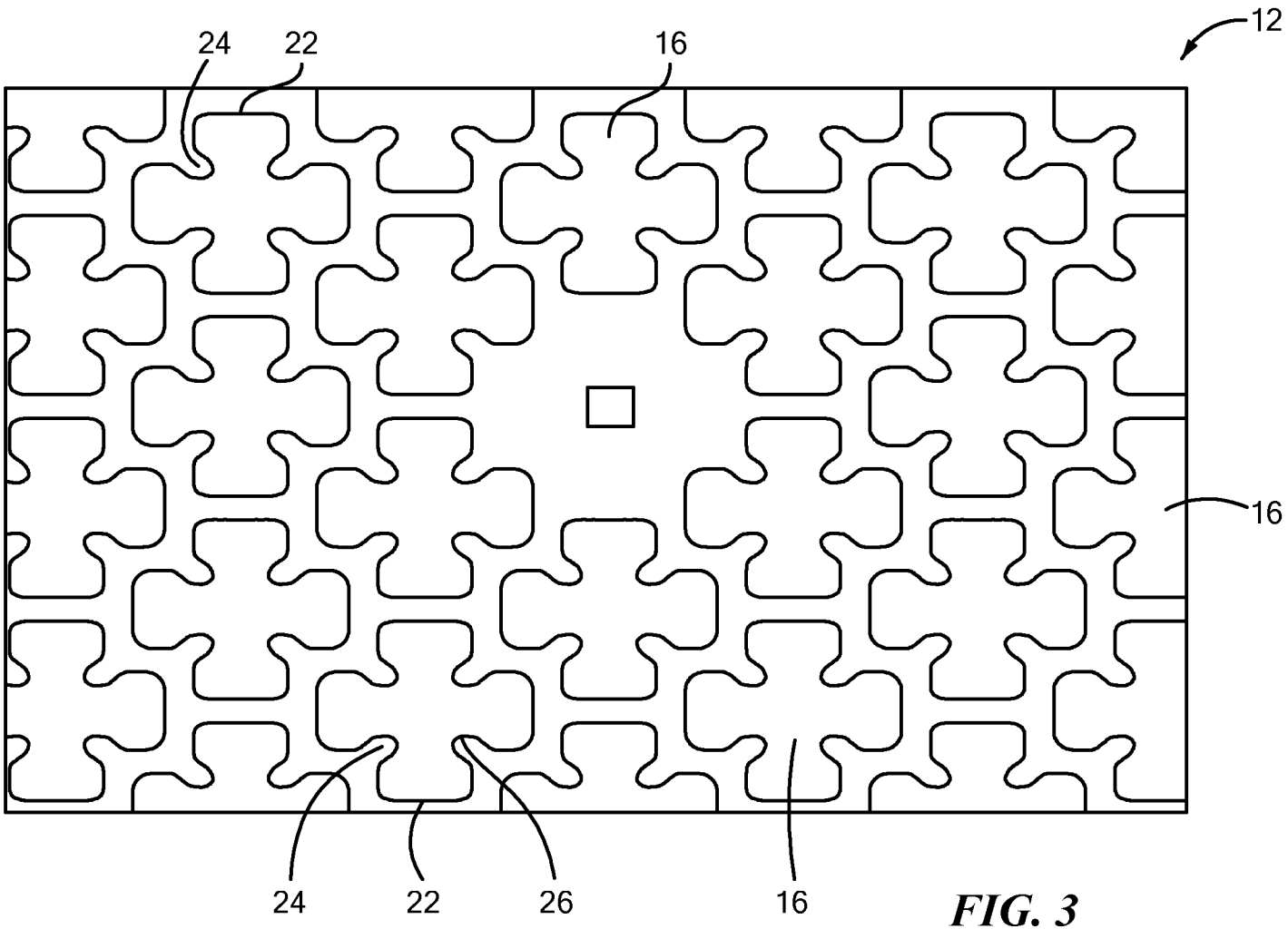
FIG. 3 schematically shows a plan view of backplate configured in accordance with illustrative embodiments of the invention.

Among other shapes, a through-hole 16 having a generally symmetric, four-leaf clover shape (a/k/a "cross-shaped") should provide the desired result. FIG. 3 schematically shows a backplate 12 having through-holes 16 with this shape. Due to their shape, these through-holes 16 can be more closely spaced than that for circular/elliptical through-holes. For example, the through-holes 16 shown in FIG. 3 can be spaced as close as about two microns apart. Using this shape, the inventor built a backplate 12 with about 1700 through-holes 16. This is in contrast to a prior art design having about 1300 circular holes on a backplate having the same general overall area. As shown, the through-hole perimeters extend to areas of the backplate 12 that otherwise would be solid if circular/elliptical through-holes were used.

More generally, through-holes 16 having inner dimensional shapes with long perimeters provide more beneficial fringe capacitance when compared to conventional circular or oval shapes. In particular, the inventor discovered that inner dimensional shapes having at least two concave portions 22 and at least two convex portions 24 should provide this beneficial overall capacitance.

For example, as discussed in greater detail below, the inner dimensional shape can effectively have a hub portion 26 (FIG. 4C, for example, it is explicitly drawn), and a plurality of lobes 28 extending from the hub portion 26. The shape of the hub and/or lobe can be symmetrical or asymmetrical. Moreover, the lobes 28 can have straight portions, curved portions, or simply random shapes. In like fashion, the overall inner dimensional shape of the through-holes 16 can be somewhat random and yet, still have the hub and two or more lobe configuration. Clearly, the clover shape of FIG. 3 has this hub and lobe design and thus, at least two convex portions 24 and at least two concave portions 22.

The inner dimensional shape and size of the inner dimensional shape illustrative is substantially uniform in its entire thickness through the backplate 12. Naturally, certain tolerances may cause the shape to vary to some nominal extent without changing its basic character of its being substantially uniform. Accordingly, the through-holes 16 shown in FIG. 3 may have substantially the same shape as they do on the top, interior surface of the backplate 12 (i.e., the plan view). Conversely, other embodiments can change or otherwise vary the inner dimensional shape or size through the thickness of the backplate 12. Accordingly, the shape or size of the through-hole 16 in the middle thickness of the backplate 12 can vary substantially from that of the same through-hole 16 at the top surface of the backplate 12.

During his analysis, the inventor compared the capacitance of MEMS microphone variable capacitors to those having backplates with different through-hole designs. Each design was compared to a capacitor having no through-holes of any kind. Table 1 below shows the results of this comparison. An outer perimeter of a portion of the static substrate is considered to form the total available area of the backplate 12.

TABLE 1

Comparison of different hole shapes

| Shape of Through-holes | Approximate Total Area of Backplate taken up by Through-holes | Approximate Loss in Capacitance vs. Backplate with no Through-holes |
|---|---|---|
| Circular-smaller holes (about 6.4 microns) | 29 percent | 8 percent |
| Circular-larger holes (about 10 microns) | 31 percent | 12 percent |
| Clover holes as shown in FIG. 3 | 64 percent | 10 percent |

As shown in Table 1, the clover shaped through-holes 16 present a loss of capacitance that is greater than that of smaller circular holes, but less than that of larger circular holes. The clover shaped through-holes 16 take up just over two times the total backplate area compared to that of the larger circular through-holes. If they took up the same total backplate area, however, experiments suggest that the flow resistance of the clover shaped through-holes 16 would not be as low as that for circular shaped through-holes. The shape of the clover through-holes 16 nevertheless permits more area to be removed from the backplate 12—enough to improve flow resistance appreciably—while at the same time increasing fringe capacitance—improving signal strength to be comparable to that with prior art through-hole designs.

During these experiments using the clover holes, the inventor also noted an improvement in signal-to-noise ratio of about 6 dB when compared to the 6.4 micron circular holes. He also noted an improvement in signal-to-noise ratio of about 2 dB when compared to the 10 micron circular holes.

The inventor also experimented with 13.1 micron circular holes and noted a signal-to-noise ratio improvement that was about the same as that of the clover shaped holes. Such large holes are less desirable, however, because they more readily permit contaminants/particles through the backplate 12, and they complicate the fabrication process. It thus is undesirable to make the holes too large despite the fact that it improves signal-to-noise ratios. The discussed designs thus provide a good alternative.

Figure 4:
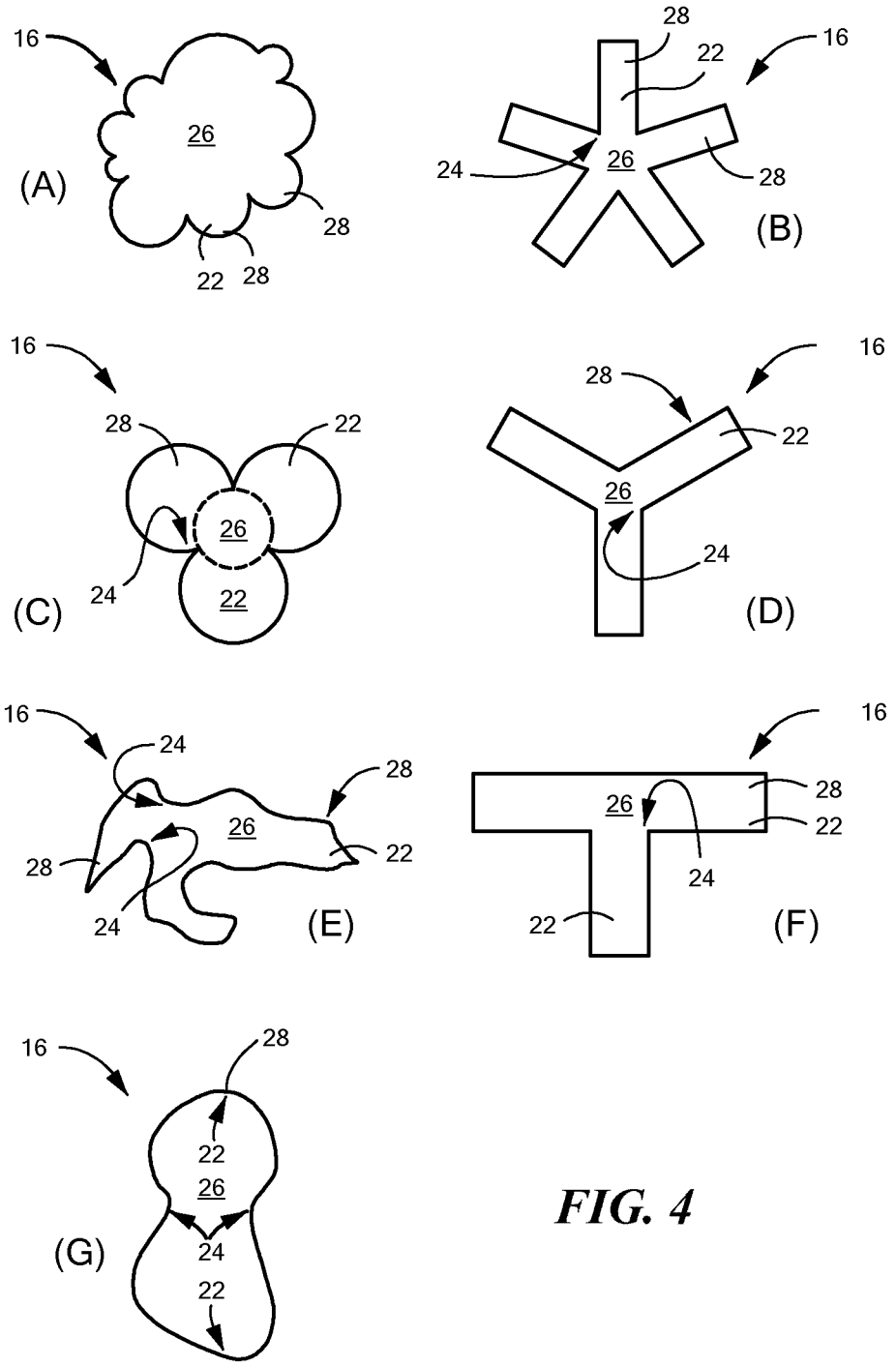
FIG. 4 schematically shows a plurality of various backplate hole shapes in accordance with a number of different embodiments of the invention.

As noted above, those skilled in the art should understand that the backplate 12 can have through-holes 16 with other shapes. For example, FIG. 4 schematically shows a number of different shapes (shapes A-G) that may be used in alternative embodiments of invention. One common feature of each of these shapes is that they have all have at least two convex portions 24 and at least two concave portions 22.

For example, the clover/cross design shown in FIG. 3 has four concave portions 22. In fact, the concave portions 22 of the clover design are bounded by four convex portions 24 that define a general hub portion 26 (the center in that case, although the hub portion 26 is not necessarily symmetrical) of the shape. These concave portions 22 may form four points of a circle/hub portion 26 (not shown) within the through-hole 16. This circle may have a diameter defined by the distance between opposing convex portions 24.

Some of those shapes shown by FIG. 4 are not symmetrical, have sharper corners (e.g., squared corners), irregular shapes, and/or multiple lobes 28. The concave portions 22 may be relatively deep (e.g., have large radii) or relatively slight. Those skilled in the art can ascertain other shapes that provide the beneficial effects of mitigating capacitance loss by increasing fringe capacitance while, at the same time, increasing flow characteristics.

Some embodiments of the invention have through-holes 16 with multiple different shapes on a single backplate 12. For example, a single backplate 12 may have a set of clover shaped through-holes 16 with four concave portions 22, a set of clover shaped through-holes 16 with three concave portions 22, and a set of circular through-holes.

As an example, some microphone designs implementing illustrative embodiments of the invention can have through-holes 16 that take-up between 40-70 percent, or more, of the backplate 12. Some embodiments take up 60 percent or more. The designer should consider structural strength issues to ensure that enough of the backplate area is maintained to prevent structural breakdown. It is anticipated that the signal-to-noise ratio of a MEMS microphone using these designs can meet or exceed 66 db (e.g., 68 db).

The inventor also discovered that through-holes 16 shaped in a manner that corresponds with the diaphragm springs 19 also can improve their flow resistance, provide improved fringe capacitance, and thus, increase the signal-to-noise ratio. Specifically, the springs 19 are considered to form a spring opening 30 (i.e., the void left open) between the diaphragm 14 and the stationary substrate portion supporting the springs 19. Illustrative embodiments thus form at least some of the through-holes 16 with an inner dimensional shape that is substantially the same as that of one or more of the spring openings 30.

Figure 5A:
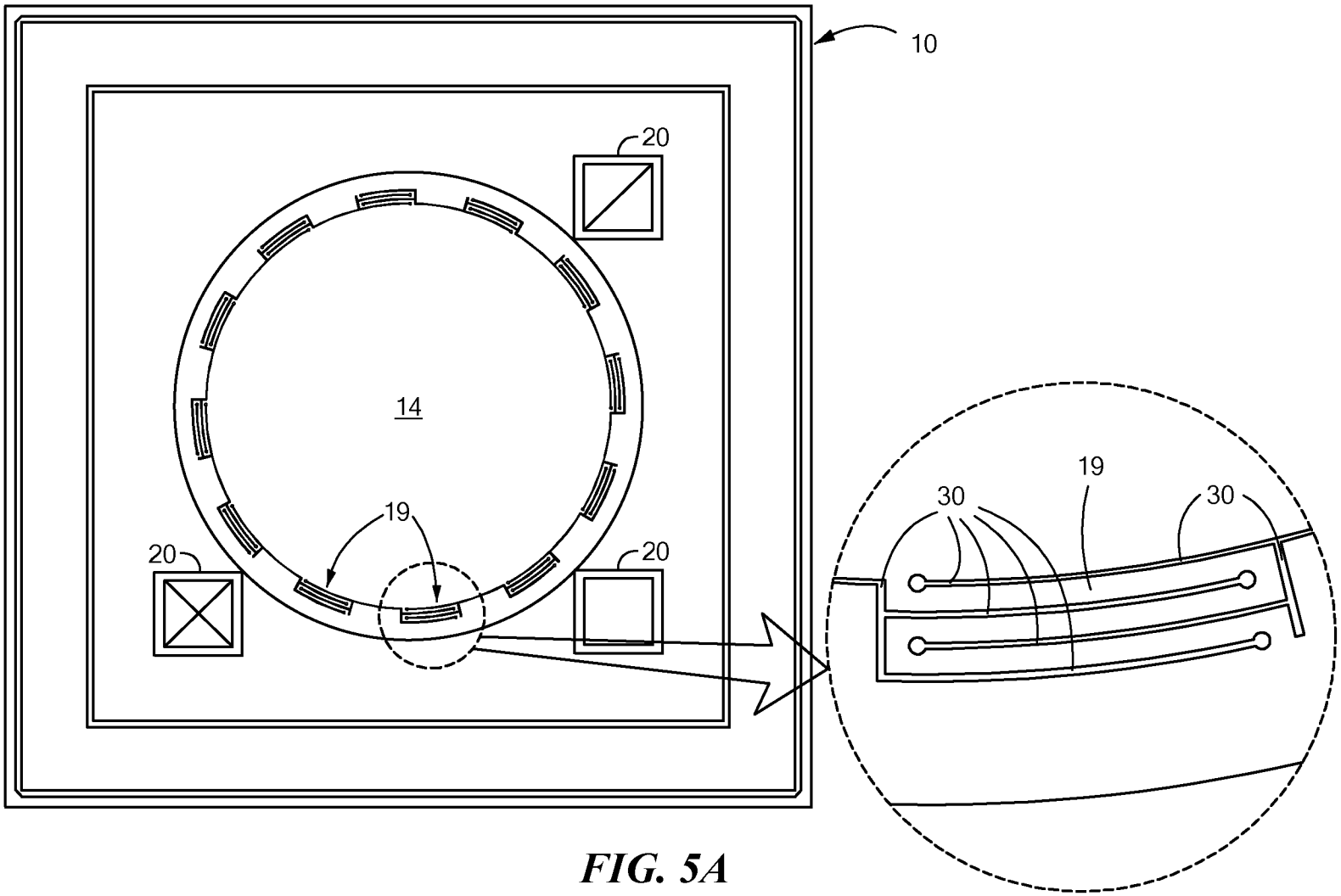
FIG. 5A schematically shows a plan view of a microphone having diaphragm springs that may be used in accordance with a first embodiment of the invention.
Figure 5B:
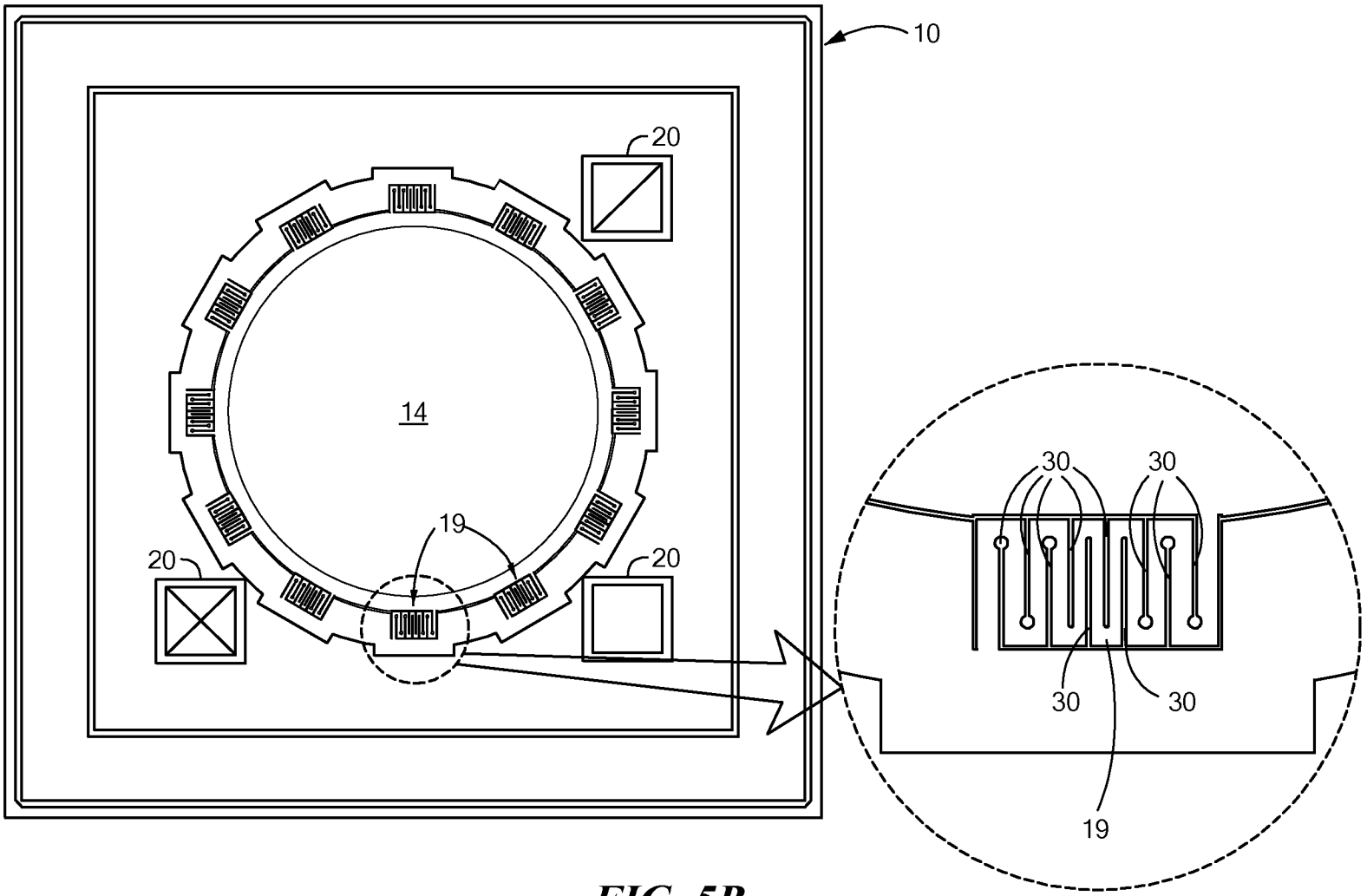
FIG. 5B schematically shows a plan view of a microphone having diaphragm springs that may be used in accordance with a second embodiment of the invention.
Figure 5C:
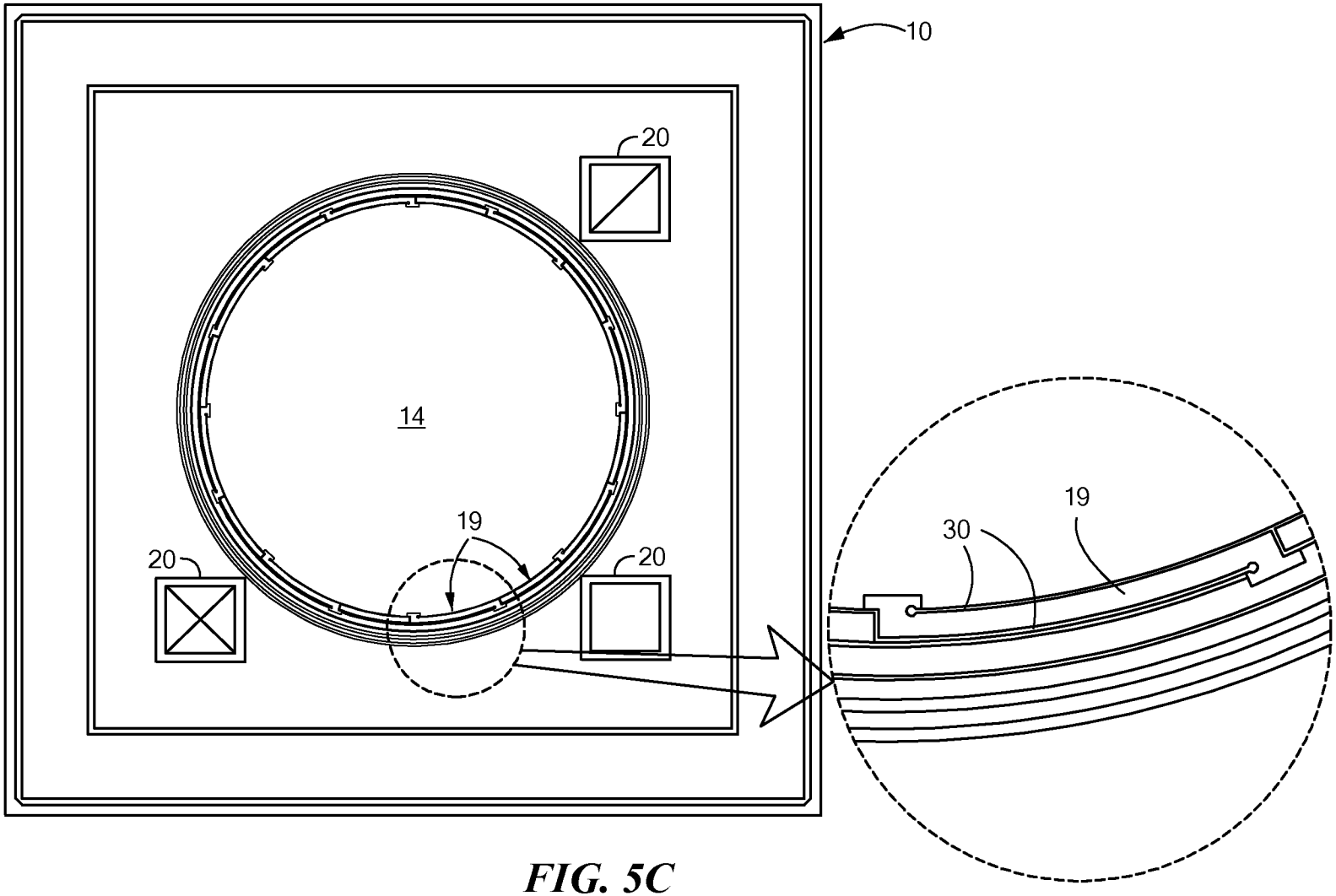
FIG. 5C schematically shows a plan view of a microphone having diaphragm springs that may be used in accordance with a third embodiment of the invention.

FIGS. 5A-5C schematically show three different types of springs 19 that illustrative embodiments may implement. Various embodiments thus configure the microphone 10 to have through-holes 16 with shapes that are based on the spring openings 30 formed by these springs 19.

For example, FIG. 5A schematically shows a serpentine shaped spring 19 having a long dimension that is generally parallel with the diaphragm 14 and the support portion of the backplate/substrate 12. Consequently, the spring 19 has a plurality of spring openings 30 with a complementary shape. Illustrative embodiments thus form the through-holes 16 with a shape that is substantially identical to or similar to that of at least one of the spring openings 30.

FIG. 5B schematically shows a second type of spring 19, which is also serpentine shaped. Unlike the serpentine spring 19 of FIG. 5A, however, the long dimension of this spring 19 is generally orthogonal to the diaphragm 14 and the supporting surface of the substrate.

FIG. 5C schematically shows a third type of spring 19, which is not serpentine shaped. Instead, this spring 19 has a generally long dimension that is approximately parallel to the diaphragm 14 and support portion of the substrate. The spring openings 30 thus have a complementary shape. It should be noted that the three spring designs shown in FIGS. 5A-5C are merely examples of various spring types that illustrative embodiments may implement. The microphone 10 thus may use other types of springs 19 that have different spring opening configurations. Accordingly, discussion of these three types of springs 19 are not intended to limit implementation to these types of springs.

Figure 6:
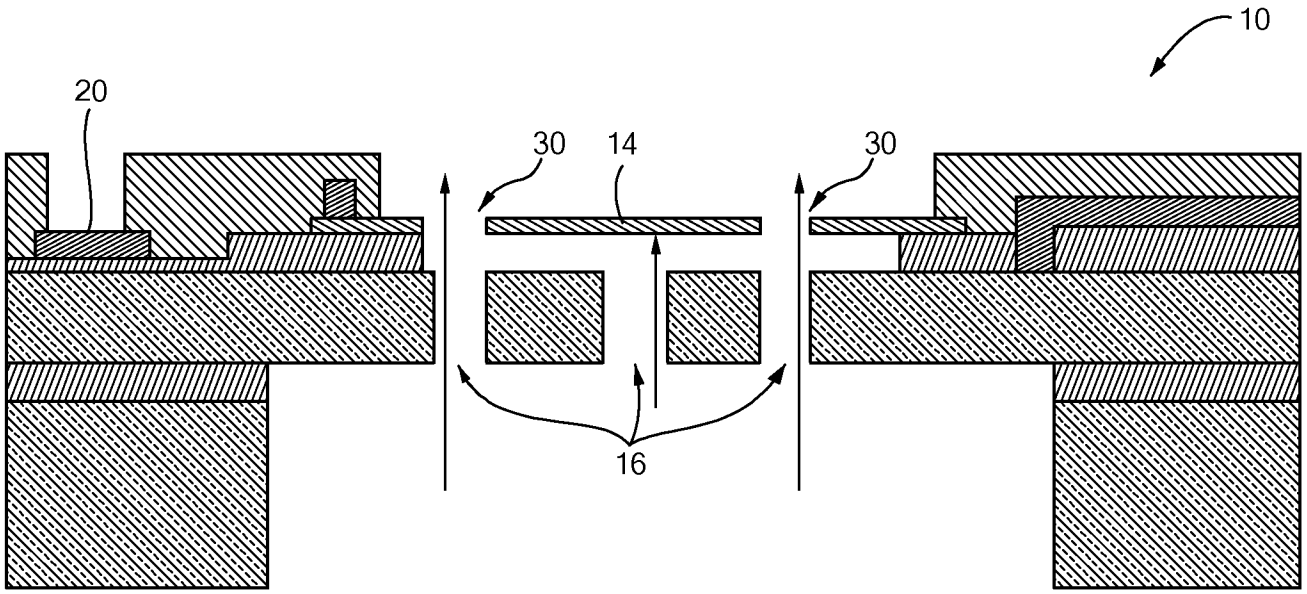
FIG. 6 schematically shows a cross-sectional view across line B-B of the MEMS device shown in FIG. 1 in accordance with alternative embodiments of the invention.

Illustrative embodiments may substantially align at least some of the through-holes 16 with the spring openings 30. This is in contrast to other designs that offset the vertical alignment of the through-holes 16 and spring openings 30. Accordingly, as shown in FIG. 6, at least a portion of an incident audio/acoustic signal can traverse substantially straight through the microphone 10. Such alignment therefore further reduces the air resistance through the microphone 10 because a portion of such acoustic signals does not travel a direction that is generally parallel to the plane of the diaphragm 14.

In some embodiments, the spring openings 30 are substantially exactly aligned with the through-holes 16, as shown in FIG. 6. Other embodiments, however, may only partially align the through-holes 16 and the spring openings 30.

In addition to being the same shape, the aligned through-holes 16 also may have substantially the same area (i.e., from the plan view) as that of the spring openings 30. Moreover, embodiments having through-holes 16 aligned in this manner may have a plurality of differently shaped through-holes 16 radially inwardly of these through-holes 16. For example, those other through-holes 16 may have any of the shapes shown in FIG. 3 of 4.

Figure 7A:
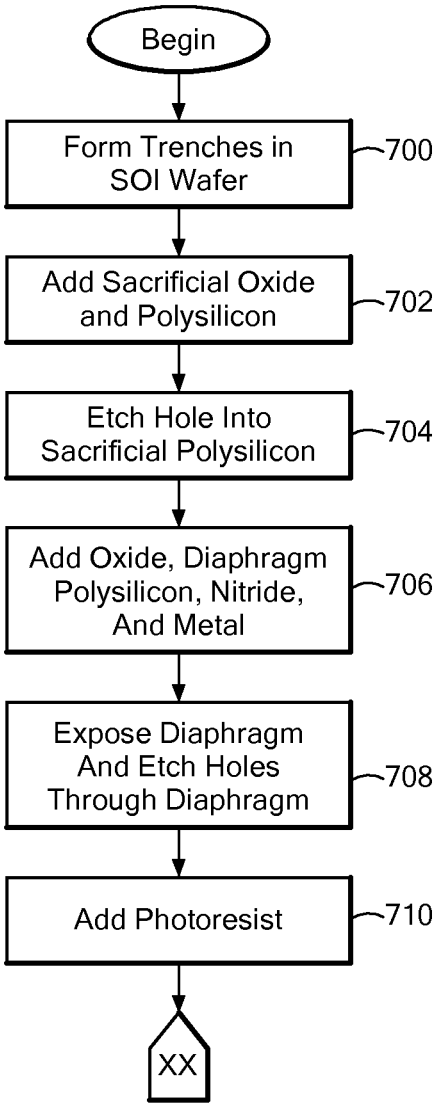
FIGS. 7A and 7B show a process of forming a MEMS microphone in accordance with illustrative embodiments of the invention.
Figure 7B:
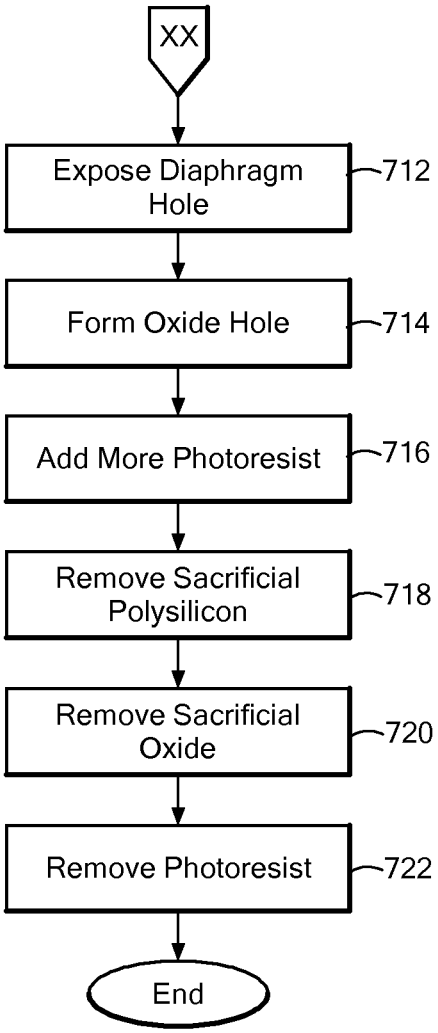

FIGS. 7A and 7B show a process of forming a microphone that is similar to the microphone 10 shown in FIGS. 1, 2, and 6 in accordance with illustrative embodiments of the invention. The remaining figures (FIGS. 8A-8G) illustrate various steps of this process. It should be noted that for simplicity, this described process is a significantly simplified version of an actual process used to fabricate the microphone 10. Accordingly, those skilled in the art would understand that the process may have additional steps and details not explicitly shown in FIGS. 7A and 7B. Moreover, some of the steps may be performed in a different order than that shown, or at substantially the same time. Those skilled in the art should be capable of modifying the process to suit their particular requirements.

The process begins at step 700, which etches trenches 38 in the top layer of a silicon-on-insulator wafer ("SOI wafer 40"). These trenches 38 ultimately form the through-holes/apertures 16—some of which may be aligned, shaped, sized, configured, etc . . . in the manners discussed above.

Figure 8A:
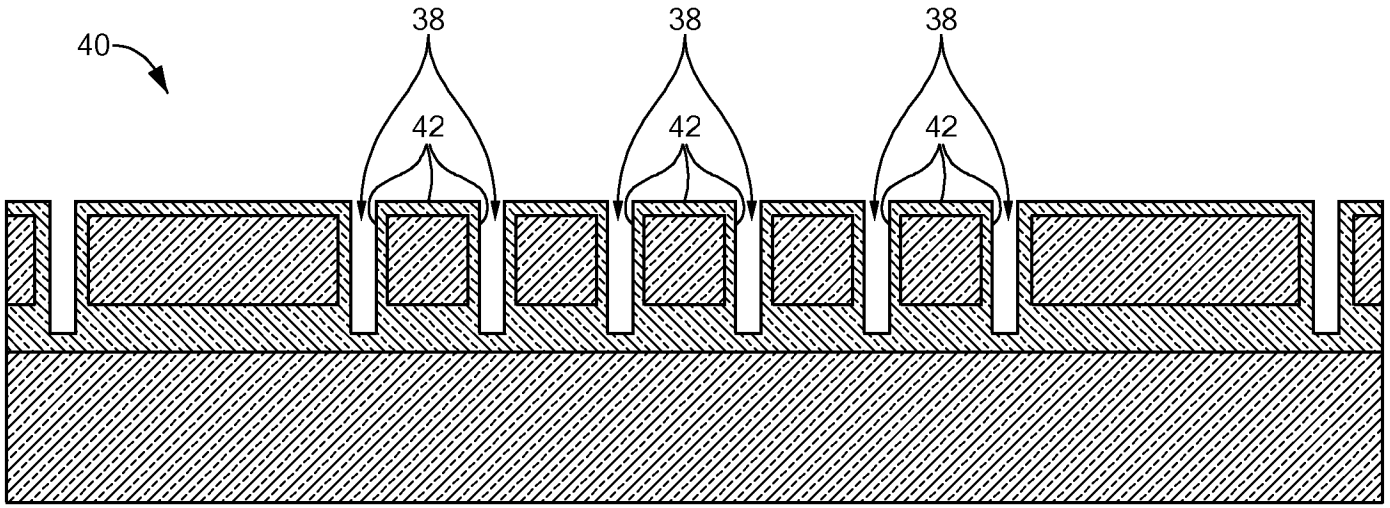
FIGS. 8A-8G schematically show cross-sectional views of various steps of the process of FIGS. 7A and 7B in accordance with illustrative embodiments of the invention.

Next, the process adds sacrificial oxide 42 to the walls of the trenches 38 and along at least a portion of the top surface of the top layer of the SOI wafer 40 (step 702). Among other ways, this oxide 42 may be grown or deposited. FIG. 8A schematically shows the wafer at this point in the process. Step 702 continues by adding sacrificial polysilicon 44 to the oxide lined trenches 38 and top-side oxide 42.

Figure 8B:
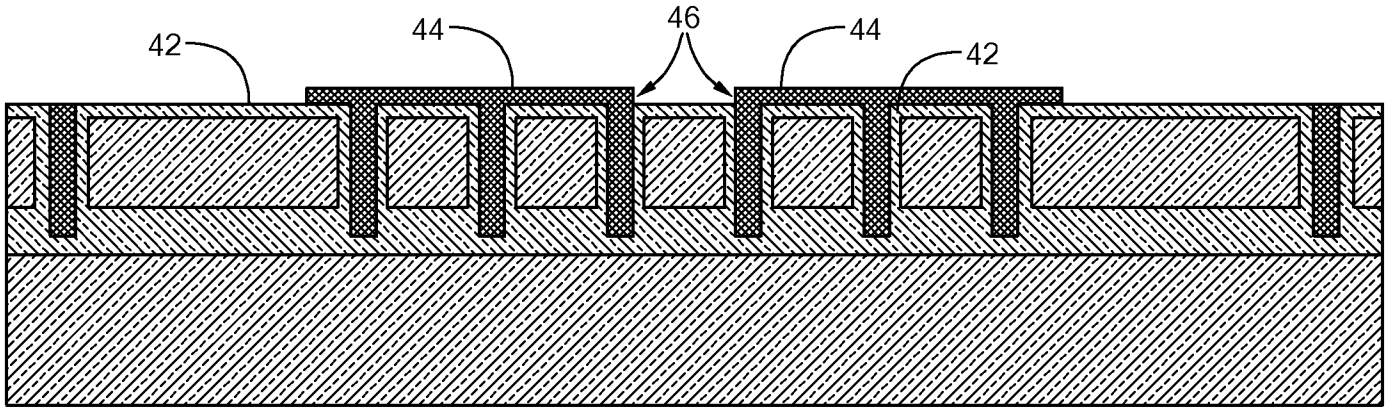
Figure 8C:
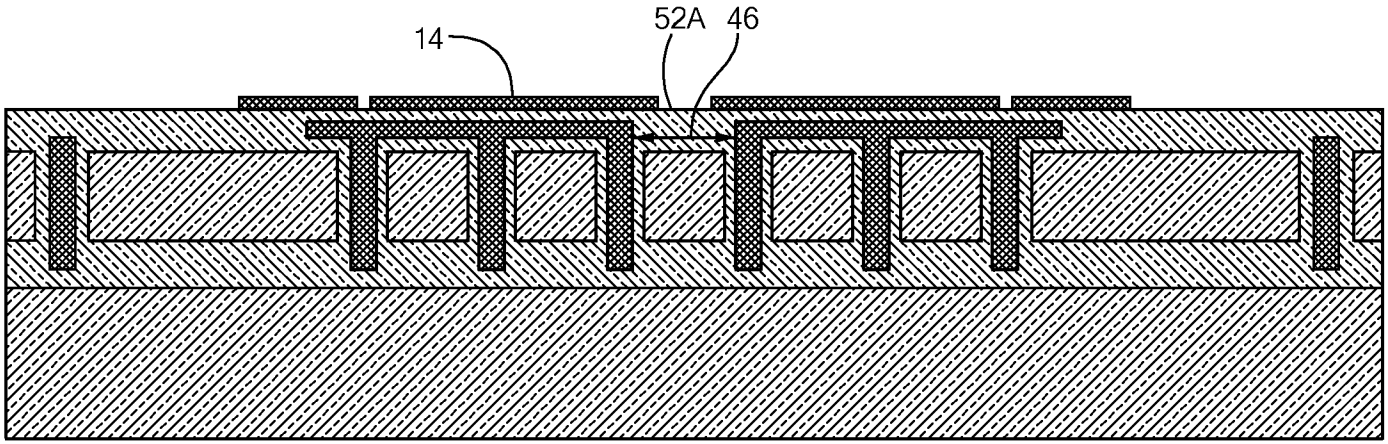

After adding the sacrificial polysilicon 44, the process etches a hole 46 into the sacrificial polysilicon 44 (step 704, see FIG. 8B). The process then continues to step 706, which adds more oxide 42 to substantially encapsulate the sacrificial polysilicon 44. In a manner similar to other steps that add oxide 42, this oxide 42 essentially integrates with other oxides it contacts. Step 706 continues by adding an additional polysilicon layer that ultimately forms the diaphragm 14 (see FIG. 8C). Although not necessary in all embodiments, this layer illustratively is patterned to substantially align at least some of the diaphragm apertures/spring openings 30 with some of the through-holes 16 in the manner discussed above.

Figure 8D:
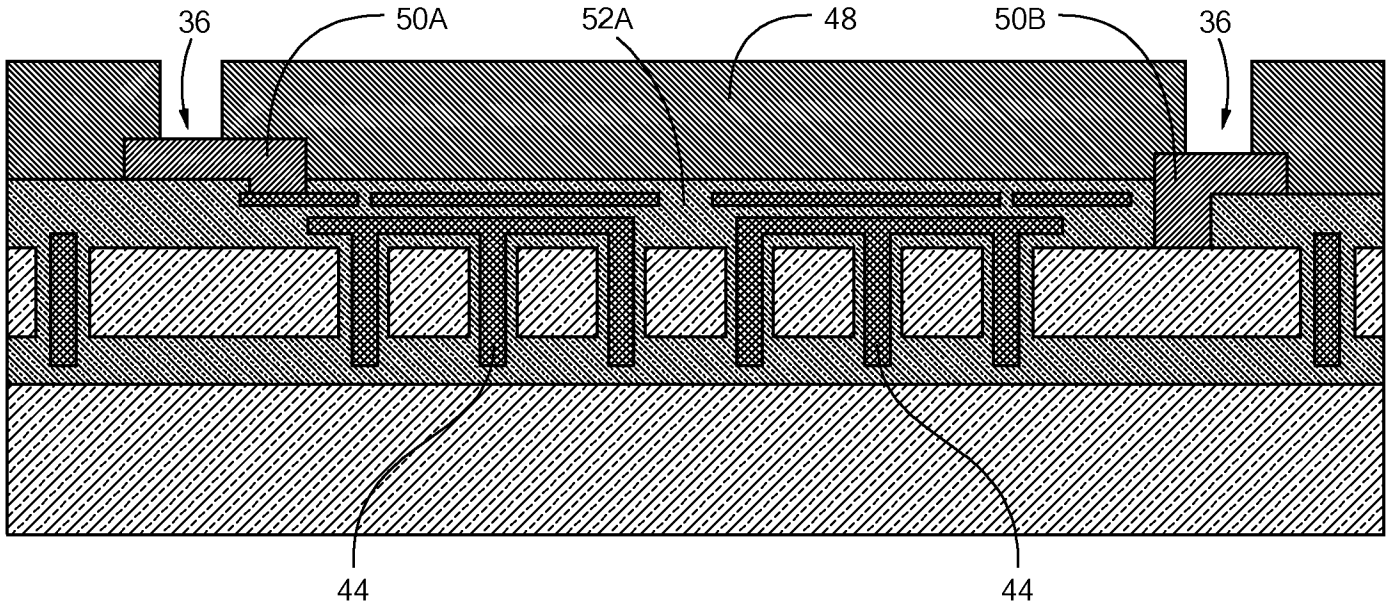

Nitride 48 for passivation and metal for electrical connectivity also are added (see FIG. 8D). For example, deposited metal may be patterned to form a first electrode 50A for placing electrical charge on the diaphragm 14, another electrode 50B for placing electrical charge on the backplate 12, and the contacts 20 for providing additional electrical connections. Note that contacts 50A and 50B are generically identified by reference number "20" in other figures.

The process then both exposes the diaphragm 14, and etches holes/voids through the diaphragm 14 (step 708). As discussed below in greater detail, one of these holes ("diaphragm hole 52A") ultimately assists in forming a pedestal 54 that, for a limited time during this process, supports the diaphragm 14. A photoresist layer 56 then is added, completely covering the diaphragm 14 (step 710). This photoresist layer 56 serves the function of an etch mask.

Figure 8E:
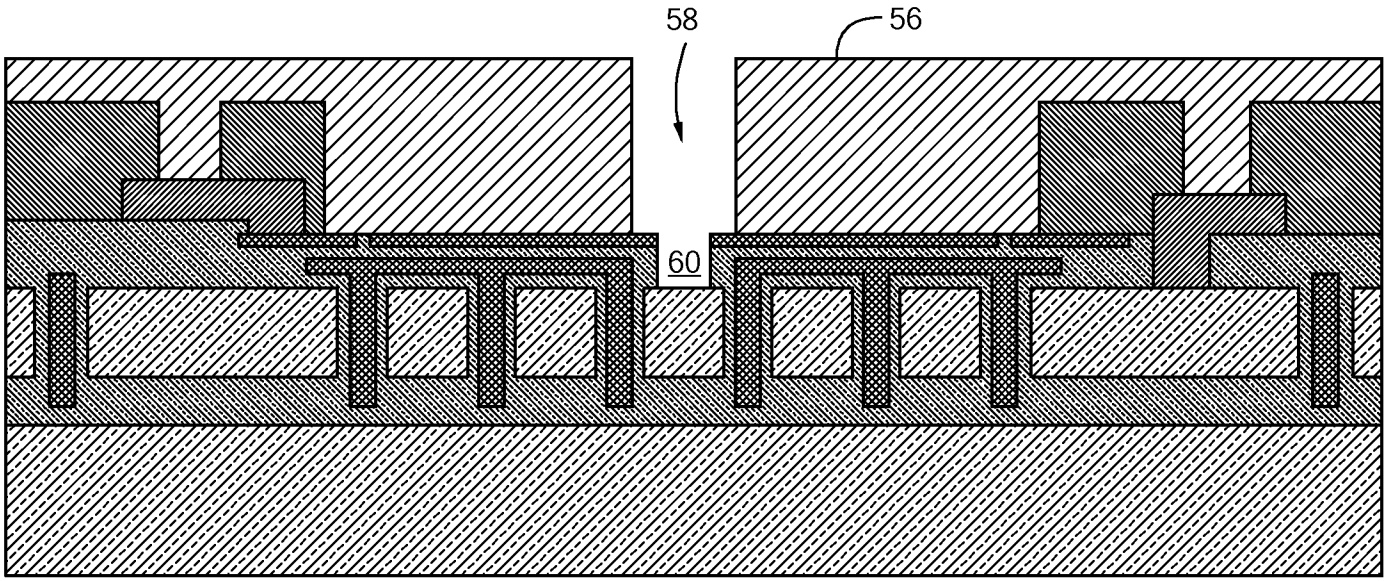

After adding the photoresist 36, the process exposes the diaphragm hole 52A (step 712). To that end, the process forms a hole ("resist hole 58") through the photoresist 36 by exposing that selected portion to light (FIG. 8E). This resist hole 58 illustratively has a larger inner diameter than that of the diaphragm hole 52A.

After forming the resist hole 58, the process forms a hole 60 through the oxide 42 (step 714). In illustrative embodiments, this oxide hole 60 effectively forms an internal channel that extends to the top surface of the SOI wafer 40.

It is expected that the oxide hole 60 initially will have an inner diameter that is substantially equal to the inner diameter of the diaphragm hole 52A. A second step, such as an aqueous HF etch, may be used to enlarge the inner diameter of the oxide hole 60 to be greater than the inner diameter of the diaphragm hole 52A. This enlarged oxide hole diameter essentially exposes a portion of the bottom side of the diaphragm 14. In other words, at this point in the process, the channel forms an air space between the bottom side of the diaphragm 14 and the top surface of the backplate 12.

Also at this point in the process, the entire photoresist layer 56 may be removed to permit further processing. For example, the process may pattern the diaphragm 14, thus necessitating removal of the existing photoresist layer 56 (i.e., the mask formed by the photoresist layer 56). Other embodiments, however, do not remove this photoresist layer 56 until step 622 (discussed below).

Figure 8F:
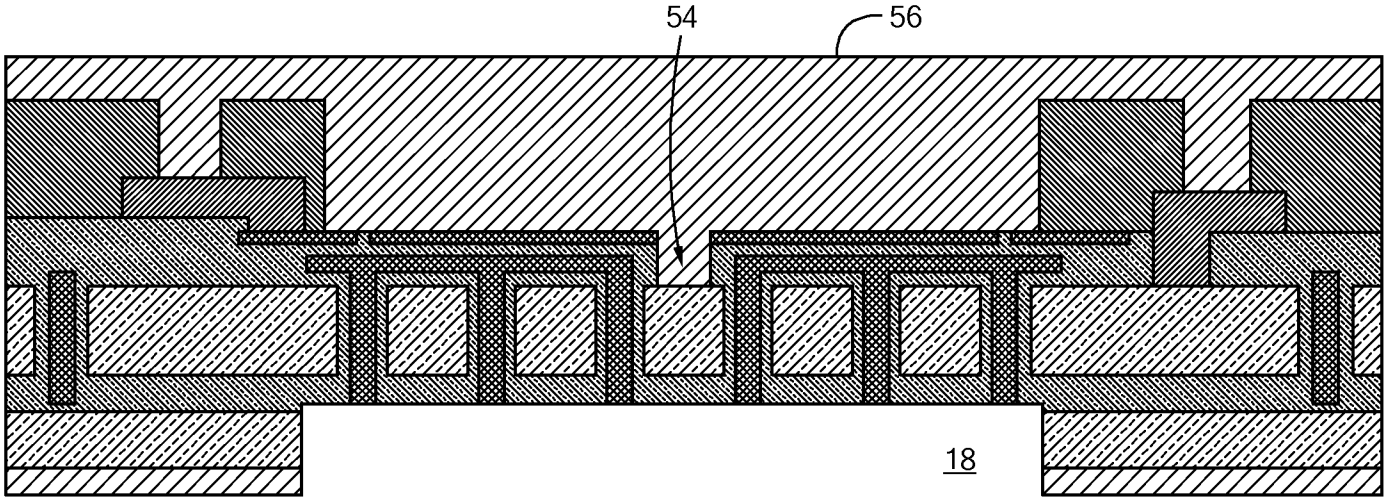

The process then continues to step 716, which adds more photoresist 36, to substantially fill the oxide and diaphragm holes 40 and 34 (FIG. 8F). The photoresist 36 filling the oxide hole 60 contacts the silicon of the top SOI layer, as well as the underside of the diaphragm 14 around the diaphragm hole 52A.

The embodiment that does not remove the original mask thus applies a sufficient amount of photoresist 36 in two steps (i.e., first the mask, then the additional resist to substantially fill the oxide hole 60), while the embodiment that removes the original mask applies a sufficient amount of photoresist 36 in a single step. In both embodiments, as shown in FIG. 8F, the photoresist 36 essentially acts as the single, substantially contiguous apparatus above and below the diaphragm 14. Neither embodiment patterns the photoresist 36 before the sacrificial layer is etched (i.e., removal of the sacrificial oxide 42 and polysilicon 44, discussed below).

In addition, the process may form the backside cavity 18 at this time. To that end, as shown in FIG. 8F, conventional processes may apply another photoresist mask on the bottom side of the SOI wafer 40 to etch away a portion of the bottom SOI silicon layer. This should expose a portion of the oxide layer within the SOI wafer 40 and the through-holes 16. A portion of the exposed oxide layer then is removed to expose the remainder of the sacrificial materials, including the sacrificial polysilicon 44.

At this point, the sacrificial materials may be removed. To that end, the process removes the sacrificial polysilicon 44 (step 718) and then the sacrificial oxide 42 (step 620, FIG. 8G). Among other ways, illustrative embodiments remove the polysilicon 44 with a dry etch process (e.g., using xenon difluoride) through the backside cavity 18. In addition, illustrative embodiments remove the oxide 42 with a wet etch process (e.g., by placing the apparatus in an acid bath for a predetermined amount of time). Some embodiments, however, do not remove all of the sacrificial material. For example, such embodiments may not remove portions of the oxide 42. In that case, the oxide 42 may impact capacitance.

Figure 8G:
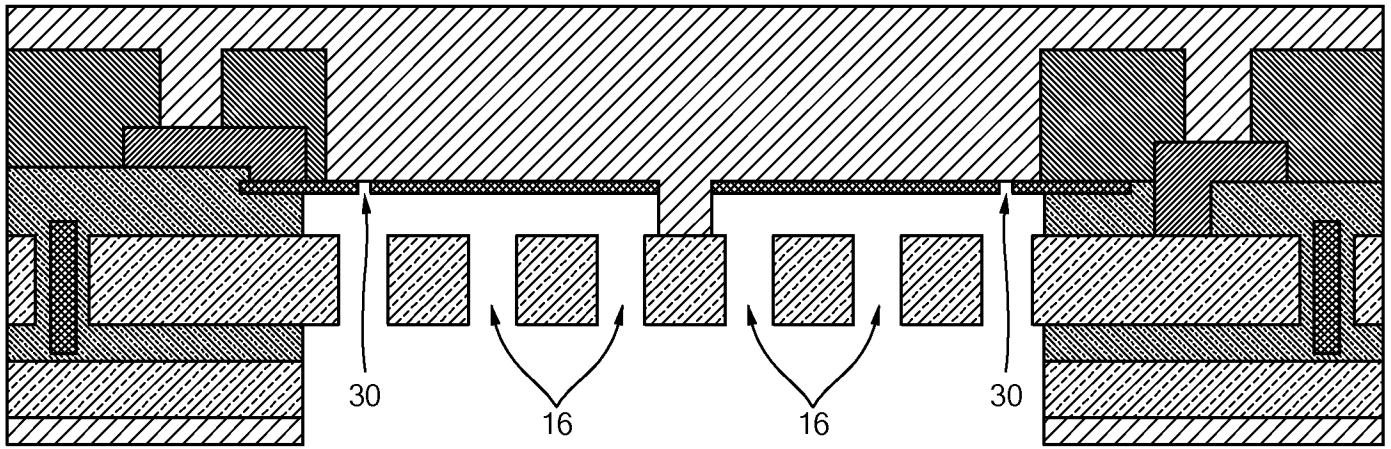

As shown in FIG. 8G, the photoresist 36 between the diaphragm 14 and top SOI layer supports the diaphragm 14. In other words, the photoresist 36 at that location forms a pedestal 54 that supports the diaphragm 14. As known by those skilled in the art, the photoresist 36 is substantially resistant to wet etch processes (e.g., aqueous HF process, such as those discussed above). It nevertheless should be noted that other wet etch resistant materials may be used. Discussion of photoresist 36 thus is illustrative and not intended to limit the scope of all embodiments.

Stated another way, a portion of the photoresist 36 is within the prior noted air space between the diaphragm 14 and the backplate 12; namely, it interrupts or otherwise forms a part of the boundary of the air space. In addition, as shown in the figures, this photoresist 36 extends as a substantially contiguous apparatus through the hole 52 in the diaphragm 14 and on the top surface of the diaphragm 14. It is not patterned before removing at least a portion of the sacrificial layers. No patterning steps are required to effectively fabricate the microphone 10.

To release the diaphragm 14, the process continues to step 622, which removes the photoresist 36/pedestal 54 in a single step. Among other ways, dry etch processes through the backside cavity 18 may be used to accomplish this step. This step illustratively removes substantially all of the photoresist 36—not simply selected portions of the photoresist 36.

It should be noted that a plurality of pedestals 42 may be used to minimize the risk of stiction between the backplate 12 and the diaphragm 14. The number of pedestals used is a function of a number of factors, including the type of wet etch resistant material used, the size and shape of the pedestals 42, and the size, shape, and composition of the diaphragm 14. Discussion of a single pedestal 54 therefore is for illustrative purposes.

Accordingly, illustrative embodiments improve the signal-to-noise ratio of a MEMS microphone by incorporating specially shaped through-holes 16 in the backplate 12. As noted above, when configured appropriately, this can beneficially improve the signal to noise ratio of the MEMS microphone despite reducing the surface area for its critical variable capacitor.

Although the above discussion discloses various exemplary embodiments of the invention, it should be apparent that those skilled in the art can make various modifications that will achieve some of the advantages of the invention without departing from the true scope of the invention.

What is claimed is:

1. A MEMS microphone comprising:

a backplate having a backplate interior surface;

a diaphragm having a plurality of through-holes, the diaphragm spaced from the backplate and facing the backplate interior surface, the diaphragm being movably coupled with the backplate to form a variable capacitor, the backplate having a plurality of through-holes, substantially all of the through-holes each having an inner dimensional shape on the backplate interior surface, each inner dimensional shape having a plurality of convex portions and a plurality of concave portions, each inner dimensional shape also having at least a curved portion, wherein the inner dimensional shape has a hub and a plurality of lobes extending from the hub; and a plurality of springs suspending the diaphragm above the backplate, the plurality of springs forming a pattern of openings along the periphery of the diaphragm, wherein the plurality of diaphragm through-holes have long meandering perimeters, further wherein the inner dimensional shape is generally cross-shaped to generally form a clover shape.

2. The microphone as defined by claim 1 wherein the backplate has an outer perimeter forming a backplate area, and at least two through-holes have a combined area that is substantially between 40-70 percent of the backplate area.

3. A MEMS microphone comprising:

a backplate having a backplate interior surface;

a diaphragm having a plurality of through-holes, the diaphragm spaced from the backplate and facing the backplate interior surface, the diaphragm being movably coupled with the backplate to form a variable capacitor, the backplate having a plurality of through-holes, substantially all of the through-holes having an inner dimensional shape on the backplate interior surface, the inner dimensional shape has a hub and a plurality of lobes extending from the hub; a plurality of springs suspending the diaphragm above the backplate, the plurality of springs forming a pattern of openings along the periphery of the diaphragm, wherein the plurality of diaphragm through-holes have long meandering perimeters, further wherein the inner dimensional shape is generally cross-shaped to generally form a clover shape.

4. The microphone as defined by claim 3 wherein the backplate has an outer perimeter forming a backplate area, the at least two through-holes having a combined area that is between 50 and 60 percent of the backplate area.

* * * * *